US005584719A

United States Patent [19]

Tsuji et al.

[11] Patent Number: 5,584,719

[45] Date of Patent: Dec. 17, 1996

[54] LOCK RELEASE STRUCTURE OF CONNECTOR

[75] Inventors: Masanori Tsuji; Motohisa Kashiyama; Takuya Kitamura, all of Shizuoka-ken, Japan

[73] Assignee: Yazaki Corporation, Tokyo, Japan

[21] Appl. No.: 399,419

[22] Filed: Mar. 7, 1995

[30] Foreign Application Priority Data

Mar. 8, 1994 [JP] Japan ..... 6-037044

[51] Int. Cl.[6] ..... H01R 13/54

[52] U.S. Cl. ..... 439/354; 439/357

[58] Field of Search ..... 439/350, 351, 439/352, 353, 354, 355, 356, 357, 358, 345

[56] References Cited

U.S. PATENT DOCUMENTS

| | | | |
|---|---|---|---|
| 3,711,816 | 6/1973 | Schumacher | 439/352 |
| 4,904,201 | 2/1990 | Pelletier | 439/352 |
| 5,217,385 | 6/1993 | Inoue et al. | 439/353 |

FOREIGN PATENT DOCUMENTS

| | | |
|---|---|---|
| 2-18936 | 5/1990 | Japan . |
| 5-2384 | 1/1993 | Japan . |

*Primary Examiner*—Hien D. Vu

*Attorney, Agent, or Firm*—Wigman, Cohen, Leitner & Myers, P.C.

[57] ABSTRACT

A lock release structure of a connector (23) for locking a male connector (21) with a female connector (27) having a lock portion (51) includes: a lock arm (33) formed in an outer surface of the male connector and having a lock projection (49) engaged with the lock portion (51) of the female connector when both the male and female connectors are locked with each other; and two lock release operation walls (39) formed on both sides of a free end (35) of the lock arm (33). Each of the lock release operation walls is formed with an inner lock engagement release surface (43) brought into contact with one of two free end side surfaces (37) of the lock arm, when the lock release operation walls are depress toward each other, to deform the lock arm by a predetermined distance and thereby to release the lock projection of the lock arm from the lock portion (51) of the female connector. The lock arm can be prevented from being released by an inadvertent external force and is protected from an excessive external force.

11 Claims, 3 Drawing Sheets

LOCK RELEASE STRUCTURE OF CONNECTOR

BACKGROUND OF THE INVENTION

1. Technical Field

The present invention relates to a lock release structure of a connector, and more specifically to a connector lock release structure which can release a lock condition of the connector by deforming a lock arm.

2. Description of the Related Art

An example of the lock release structure for a connector is disclosed in Japanese Published Unexamined Utility Model Application No. 5-2384, which can release a lock condition of two mated male and female connectors. In this structure, a deformable lock arm is attached to an upper surface of the male connector. Further, a push portion is formed at a free end of the lock arm, and a lock projection is formed at an intermediate portion thereof. On the other hand, a lock recess (to which the lock projection of the male connector is engaged) is formed in a hood portion of the female connector. In addition, a pair of first opposing engage projections are formed on both sides of the lock arm of the male connector, and a pair of second opposing engage projections are formed also on both sides of an opening edge of the hood portion of the female connector.

To lock the above-mentioned male and female connectors with each other, the male connector is inserted and pushed into the hood portion of the female connector until the lock projection of the male connector is engaged with the lock recess of the female connector. Under these conditions, when the push portion of the lock arm of the male connector is depressed, since the lock arm is deformed to a lock release position, the lock projection of the male connector is released from the lock recess of the female connector and in addition the first opposing engagement projections of the male connector are engaged with the second opposing engagement projections of the female connector, so that the lock arm can be held at the lock release position. Under these conditions, when the male connector is moved away from the female connector, it is possible to easily remove the male connector from the female connector.

In the above-mentioned related art connector, however, when an external force is applied to the push portion of the lock arm of the male connector inadvertently, since the lock arm is deformed to the lock release position, the first opposing engagement projections of the male connector are engaged with the second opposing engagement projections of the female connector inadvertently, so that the lock arm is kept at the lock release position. Under these conditions, since the lock projection is already disengaged from the lock recess, when the two mated connectors are vibrated for instance, the male connector is easily removed from the hood portion of the female connector.

Further, when the lock arm is deformed by depressing the push portion thereof, since the force applied to the push portion is determined on the basis of only worker's feeling, if an excessive force is applied to the lock arm, there exists another problem in that the lock arm is easily deformed or damaged.

SUMMARY OF THE INVENTION

With these problems in mind, therefore, it is the object of the present invention to provide a lock release structure of a connector which can prevent two mated connectors from being unlocked inadvertently and further prevent damage to or deformation of the lock arm from an excessive force.

To achieve the above-mentioned object, the present invention provides a lock release structure of a connector (23) for locking a male connector (21) with a female connector (27) having a lock portion (51), which includes: a lock arm (33) formed in an outer surface of the male connector and having a lock projection (49) engaged with the lock portion (51) of the female connector when both the male and female connectors are locked with each other; and two lock release operation walls (39) formed on both sides of a free end (35) of said lock arm (33) and in the outer surface of the male connector, each of said lock release operation walls being formed with an inner lock engagement release surface (43) brought into contact with one of two free end side surfaces (37) of said lock arm, when said lock release operation walls are deformed toward each other, to deform said lock arm by a predetermined distance and thereby to release the lock projection of said lock arm from the lock portion (51) of the female connector.

Further, each of said lock release operation walls (39) is further formed with an inner engage groove (45) engaged with one of the free end side surfaces (37) of said lock arm for providing a lock click feeling, when said lock arm is deformed by the predetermined distance by said lock release operation walls. Further, the inner lock engagement release surface (43) formed in said lock release operation wall (39) is formed into a circular arc shape extending outward and also downward from a middle portion of said lock release operation wall (39). Further, a notched grip portion (41) is formed in an outer free end surface of each of said lock release operation walls (39). Further, the lock portion (27) of the female connector (51) is an inner wall portion formed in an inner circumferential surface of a hood portion (25) of the female connector.

Further, the present invention provides a lock structure for a connector (21) for locking a male connector (23) with a female connector (27) having a lock portion (51), which includes: a lock arm (33) formed in an outer surface of the male connector and having a lock projection (49) engaged with the lock portion (51) of the female connector when both the male and female connectors are locked with each other; and at least one lock release operation wall (39) formed on at least one side of a free end (35) of said lock arm (33) and in the outer surface of the male connector, said lock release operation wall being formed with an inner lock engage release surface (43) brought into contact with a free end side surface (37) of said lock arm, when said lock release operation wall is deformed toward said lock arm, to deform said lock arm by a predetermined distance and thereby to release the lock projection of said lock arm from the lock portion (51) of the female connector.

Further, the present invention provides a lock release structure of a connector (21) for locking a male connector (23) with a female connector (27) having a lock portion (51), which includes: a lock arm (33) formed in an outer surface of the male connector and having a lock projection (49) engaged with the lock portion (51) of the female connector when both the male and female connectors are locked with each other; and two lock arm protective walls (39) formed on both sides of a free end (35) of said lock arm (33) and in the outer surface of the male connector, each of said lock arm protective walls being formed with an inner lock engagement release surface (43) brought into contact with one of two free end side surfaces (37) of said lock arm, when said lock arm protective walls are deformed toward each other, to deform said lock arm by a predetermined distance and thereby to release the lock projection of said lock arm from the lock portion (51) of the female connector.

In the lock structure of a connector according to the present invention, since the two lock release operation walls serve as two lock arm protective walls, an excessive force will not be applied to the lock arm, so that it is possible to prevent the lock arm from being damaged or broken inadvertently.

Further, even if some external force is applied to the lock release operation walls inadvertently, although the lock arm is deformed to some extent, since the lock release operation walls restore to the original positions by the elastic force thereof after having released from the external force, it is possible to prevent the lock condition from being released inadvertently.

Further, when the two lock release operation walls are pinched and bent toward each other, since the engagement projections of the lock arm of the male connector are engaged with the inner engagement grooves of the two lock release operation walls, it is possible to obtain a lock click feeling at the lock release position where the two connectors can be unlocked, so that it is possible for the worker to know that the lock projection of the lock arm of the male connector is disengaged from the lock portion or wall of the female connector. In addition, since the inner engage grooves are formed on the lock release operation walls, respectively, it is possible to always maintain the deformation rate of the lock arm at a constant level, so that the lock arm can be prevented from an excessive force.

DETAILED DESCRIPTION OF THE EMBODIMENTS

An embodiment of the lock release structure of a connector according to the present invention will be described hereinbelow with reference to the attached drawings.

Figure 1A:
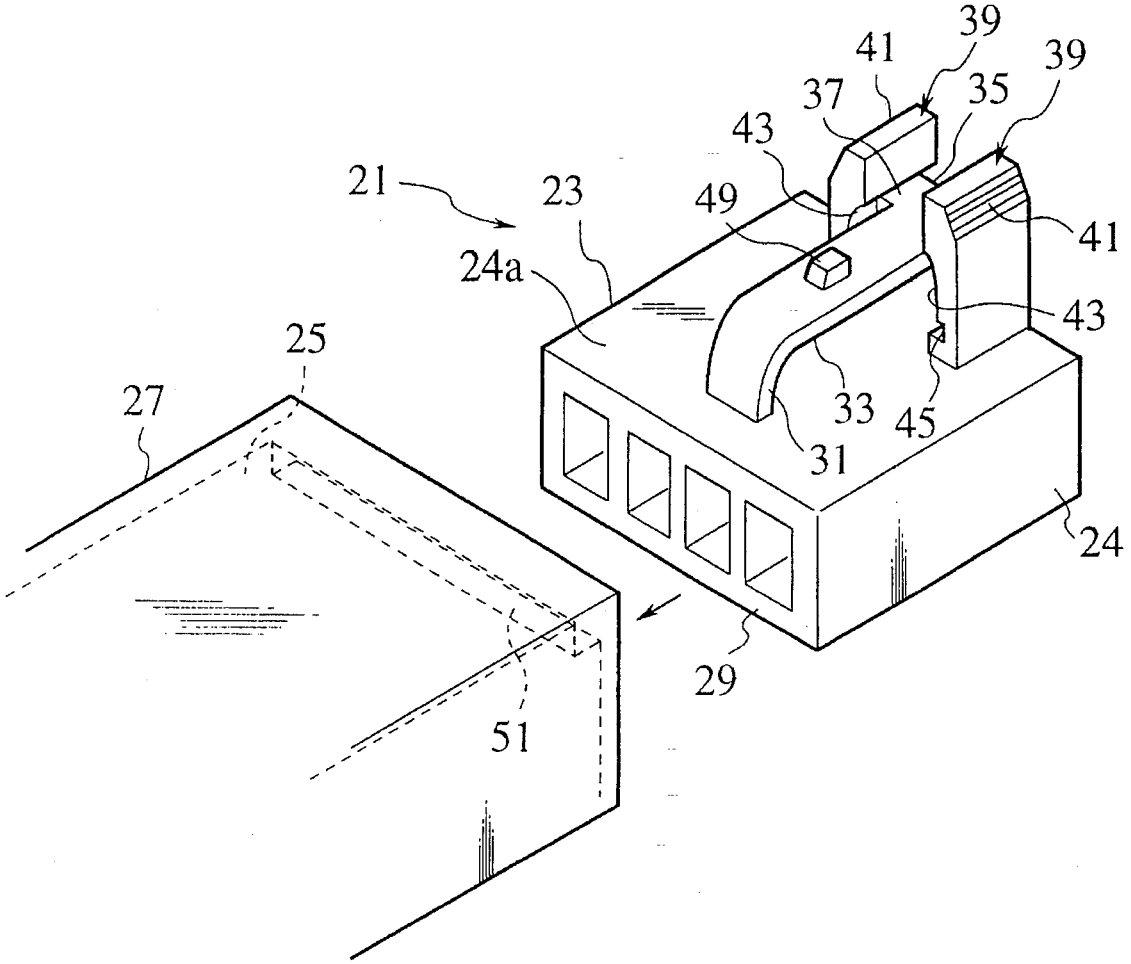
FIG. 1(A) is a perspective view showing male and female connectors to which the lock release structure according to the present invention is applied.
Figure 1B:
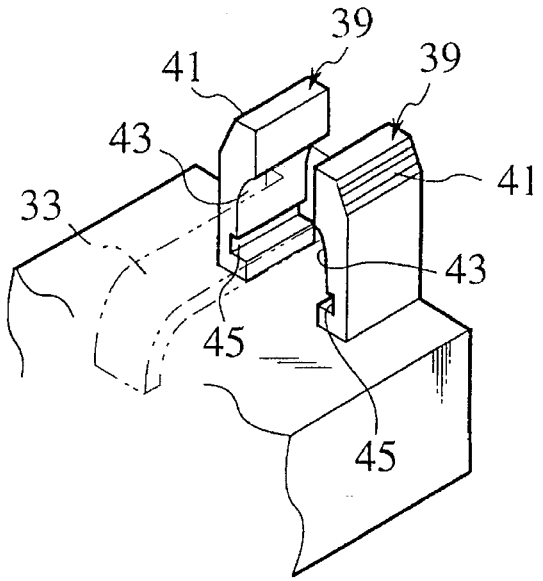
FIG. 1(B) is a partial perspective view showing only the male connector.
Figure 2A:
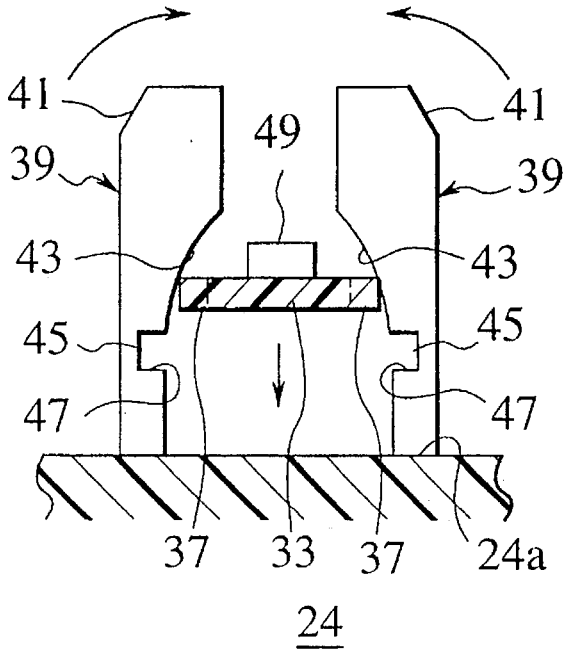
FIG. 2(A) is a cross-sectional view showing the lock arm and the lock release operation walls of the lock release structure according to the present invention, in which the lock release operation walls are not yet deformed.

In FIGS. 1(A) and (B) and FIGS. 2(A) and (B), a connector 21 is composed of a male connector 23 and a female connector 27. The female connector 27 has an engage hood 25 into which the male connector 23 is inserted. A deformable lock arm 33 is formed integral with an upper surface 24*a* of a connector housing 24 of the male connector 23 so as to extend beginning from a base end portion 31 (near a front engagement surface 29) to a rear end portion of the male connector 23. Further, the lock arm 33 is formed with a pair of engagement projection portions 37 on both sides of a free end thereof so as to extend in the width direction of the lock arm 33. Further, on both sides of the engage projection portions 37, a pair of opposing lock release operation walls 39 are formed also integral with the upper surface 24*a* of the connector housing 24 of the male connector 23 in such a way as to sandwich the lock arm 33. Here, only one of the lock release operation walls 39 is described in further detail. The lock release operation wall 39 is elastically deformable toward the lock arm 33 along the upper surface 24*a* of the connector housing 24 of the male connector 23. Further, the lock release operation wall 39 is formed with an outer notched-surface grip portion 41 on the upper outer surface thereof and with an inner lock engagement release surface 43 on the lower inner surface thereof. The inner lock engagement release surface 43 is formed into a circular arc shape extending outwardly and also downward from the middle portion of the lock release operation wall 39. In addition, the lock release operation wall 39 is formed with an engagement groove 45 near the base end portion thereof (i.e., near the upper surface 24*a* of the connector housing 24 of the male connector 23). Here, the lower side of the opening edge portion of the engagement groove 45 projects less inwardly toward the lock arm (33) side, as compared with the upper side of the opening edge portion of the engagement groove 45. With this lower side of the opening edge portion of the engagement groove 45 of the lock release operation wall 39, the lower surface of the free end of the lock arm 33 is brought into contact, which is referred to as a lock arm contact portion 47.

Figure 2B:
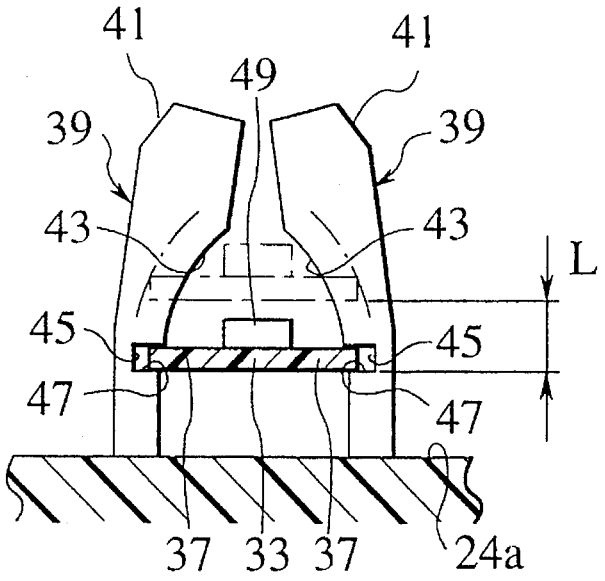
FIG. 2(B) is a cross-sectional view showing the same lock arm and the same lock release operation walls, in which the lock release operation walls have been deformed.

As described above, since a pair of the lock release operation walls 39 are arranged on both sides of the free end 35 (i.e., the engagement projection portions 37) of the lock arm 33 so as to be opposed to each other, when the two lock release operation walls 39 are deformed toward each other with the lock arm 33 sandwiched therebetween, by gripping the two notched-surface grip portions 41 of the two lock release operation walls 39, the free end portion 35, that is, the engagement projection portions 37 of the lock arm 33 are clamped between the two lock engagement release surfaces 43 of the lock release operation walls 39. Therefore, both the engage projection portions 37 of the free end 35 of the lock arm 33 are pushed downwardly in contact with and along the circular arc shaped lock engagement release surfaces 43 of the two lock release operation walls 39, with the result that the free end 35 of the lock arm 33 is deformed downwardly by a dimension L, as shown in FIG. 2(B).

On the other hand, a lock projection 49 is formed at an intermediate portion of the lock arm 33. Further, a lock wall 51 is formed in an upper inner surface of the opening edge portion of the engage hood portion 25 of the female connector 27. Therefore, when the lock projection 49 of the lock arm 33 is engaged with the lock wall 51 of the female connector 27, both the male and female connectors 23 and 27 can be locked with each other.

The locking and unlocking operation procedure between the male and female connectors 23 and 27 will be described hereinbelow.

Figure 3A:
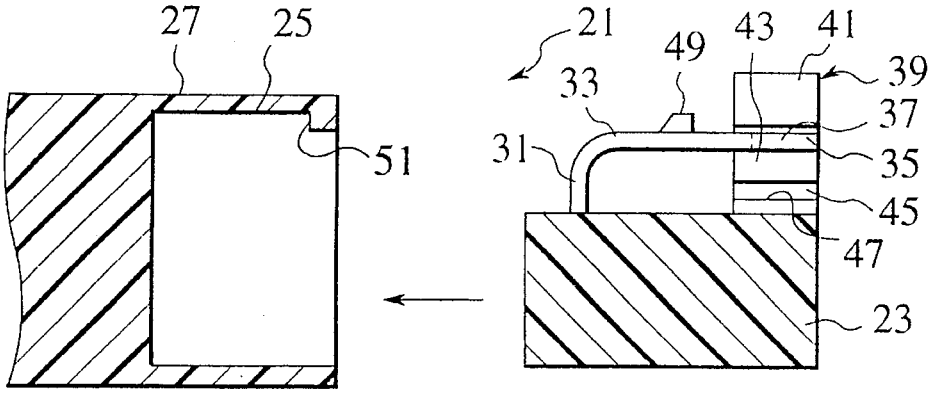
FIG. 3(A) is a cross-section view showing the male connector and the female connector of the lock release structure according to the present invention, in which the male and female connectors are not yet mated with each other.
Figure 3B:
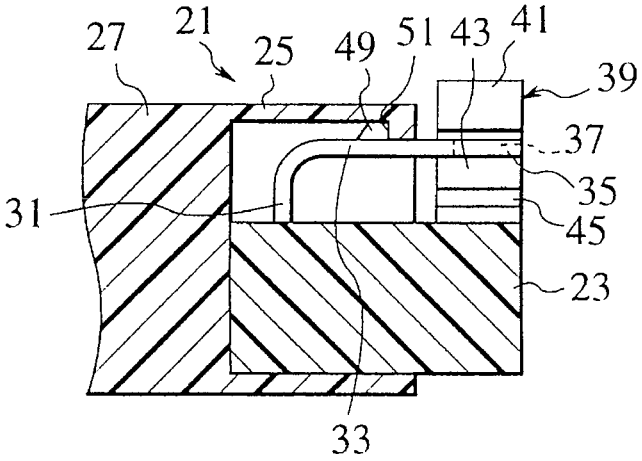
FIG. 3(B) is a cross-section view showing the same male connector and the same female connector, in which the male and female connectors have been mated with each other.
Figure 3C:
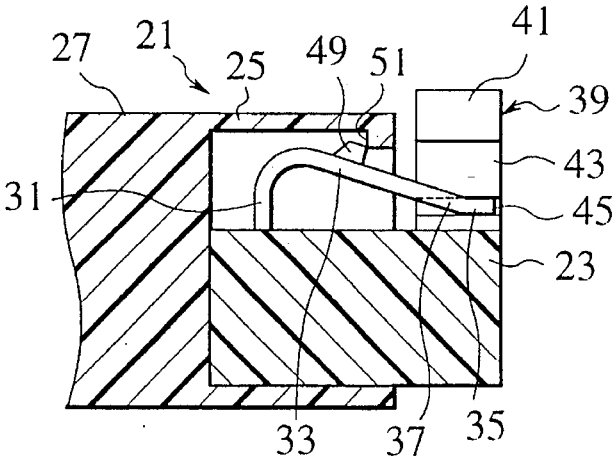
FIG. 3(C) is a cross-section view showing the same male connector and the same female connector, in which the lock release operation walls are operated to release the locked conditions of the male and female connectors.

As shown in FIG. 3(A), the male connector 23 is located at the engage hood portion 25 of the female connector 27. After that, the male connector 23 is inserted into the hood portion 25 of the female connector 27. Here, the lock projection 49 is brought into contact with the opening edge portion of the hood portion 25 of the female connector 27. When the male connector 23 is further inserted into the hood portion 25 of the female connector 27, since the lock arm 33 is deformed via the lock projection 49 by the lock wall 51 of the female connector 27 and further moved beyond the lock wall 51, the lock projection 49 of the male connector 23 is locked with the lock wall 51 of the female connector 27, as shown in FIG. 3(B). Under these locked conditions, the male connector 23 is mated and further locked with the female connector 27.

To remove the male connector 23 from the female connector 27, a pair of the lock release operation walls 39 are pinched by the fingers to deform the them toward each other, as shown in FIG. 2(B). Since the two lock release operation walls 39 are deformed inward, the engagement projection portions 37 of the free end 35 of the lock arm 33 are slid downwardly along the circular arc shaped inner lock engagement release surfaces 43 of the two lock release operation walls 39. When the engagement projection portions 37 of the lock arm 33 are moved downwardly by a dimension L, as shown in FIGS. 2(B) and 3(B), since the engagement projection portions 37 are engagement with the inner engage grooves 45 formed in the two lock release operation walls 39, respectively; that is, the lower surfaces of the engagement projection portions 37 of the lock arm 33 are brought into contact with the lock arm contact portions 47 of the lock release operation walls 39. Under these conditions, since the lock arm 33 is deformed by a predetermined dimension L, the lock projection 49 of the lock arm 33 of the male connector 23 is disengaged from the lock wall 51 formed in the female connector 27. Therefore, when the male connector 23 is extracted from the hood portion 25 of the female connector 27, it is possible to easily remove the male connector 23 from the female connector 27.

In the lock structure for a connector according to the present invention, when the two lock release operation walls 39 are pinched and bent toward each other, since the engagement projections 37 of the lock arm 33 of the male connector 23 are engagement with the inner engage grooves 45 of the two lock release operation walls 39, it is possible to obtain a click feeling at the lock release position where the two connectors can be unlocked, so that it is possible for the worker to know that the lock projection 49 of the lock arm 33 of the male connector 23 is disengaged from the lock wall 51 of the female connector 27. In addition, since the inner engagement grooves 45 are formed on the lock release operation walls 39, respectively, it is possible to always maintain the deformation rate of the lock arm 33 at a constant level, so that the lock arm 33 can be prevented from an excessive force.

Further, since the two lock release operation walls 39 serve as two lock arm protective walls, an excessive force will not be applied to the lock arm 33, so that it is possible to prevent the lock arm 33 from being damaged or broken inadvertently.

Further, even if some external force is applied to the lock release operation walls 39 inadvertently, although the lock arm 33 is deformed to some extent, since the lock release operation walls 39 restore to the original positions by the elastic force thereof after having released from the external force, it is possible to prevent the lock condition from being released inadvertently.

Further, in the above-mentioned embodiment, although a pair of the deformable lock release operation walls 39 are arranged on both sides of the free end 35 of the lock arm 33, when two protective walls for protecting the lock arm 33 are already formed on both sides of the lock arm 33, it is possible to obtain the same effect by making these protective walls deformable and by forming the inner lock engagement release surface 43 and the inner engagement groove 45 in the lock arm protective walls.

Further, in the above-mentioned embodiment, although two lock release operation walls 39 are formed on both sides of the free end 35 of the lock arm 33, it is possible to obtain the same effect when only a single lock release operation wall 39 is provided.

What is claimed is:

1. A lock release structure of an electrical connector for locking a male connector with a female connector having a lock portion, comprising:

a lock arm formed on an outer surface of the male connector and having a lock projection engaged with the lock portion of the female connector when the male and female connectors are engaged and locked with each other, said lock arm having a free end portion with two transversely and oppositely extending engagement projections; and two deformable lock release operation walls extending upwardly from said outer surface and enclosing said two engagement projections, each of said lock release operation walls being formed with an inner lock engagement release surface brought into contact with at least one of said two engagement projections of the free end portion of said lock arm when said two lock release operation walls are deformed inwardly toward each other, said lock arm being depressed to a predetermined distance to thereby release the lock projection of said lock arm from the lock portion of the female connector.

2. The lock release structure of claim 1, wherein each of said lock release operation walls is further formed with an inner engagement groove engaged with one of the engagement projections of the free end portion of said lock arm for providing a lock click feeling when said lock arm is depressed the predetermined distance by said lock release operation walls.

3. The lock release structure of claim 1, wherein the inner lock engagement release surfaces formed in said lock release operation walls are formed into a circular arc shape extending from a middle portion of said lock release operation wall toward said outer surface of the male connector.

4. The lock release structure of claim 1, wherein a notched grip portion is formed on an outer free end surface of each of said lock release operation walls.

5. The lock release structure of claim 1, wherein the lock portion of the female connector is an inner wall portion formed on an inner surface of a hood portion of the female connector.

6. A lock structure of an electrical connector for locking a male connector with a female connector having a lock portion comprising:

a lock arm formed on an outer surface of the male connector and having a lock projection engaged with the lock portion of the female connector when the male and female connectors are locked with each other, said lock arm having a free end portion with at least one engagement projection extending transversely from said free end portion; and at least one deformable lock release operation wall extending upwardly from said outer surface and engaging said at least one engagement projection, said lock release operation wall being formed with an inner lock engagement release surface brought into contact with said least one engagement projection of the free end portion of said lock arm when said lock release operation wall is deformed inwardly toward said lock arm, said lock arm being depressed to a predetermined distance to thereby release the lock projection of said lock arm from the lock portion of the female connector.

7. A lock release structure of an electrical connector for locking a male connector with a female connector having a lock portion, comprising:

a lock arm formed on an outer surface of the male connector and having a lock projection engaged with the lock portion of the female connector when the male and female connectors are locked with each other, said lock arm having a free end portion with oppositely and transversely extending engagement projections; and two deformable lock arm protective walls extending upwardly from said outer surface and protectively enclosing said engagement projections of said lock arm, each of said lock arm protective walls being formed with an inner lock engagement release surface, each of said inner lock engagement release surfaces being brought into contact with a respective engagement projection of the free end portion of said lock arm when said lock arm protective walls are deformed inwardly toward each other, said lock arm being depressed to a predetermined distance to thereby release the lock projection of said lock arm from the lock portion of the female connector.

8. The lock release structure of claim 6, wherein said lock release operation wall is further formed with an inner engagement groove engaged with the at least one engagement projection of the free end portion of said lock arm for providing a lock click feeling when said lock arm is depressed to the predetermined distance by said lock release operation wall.

9. The lock release structure of claim 6, wherein the inner lock engagement release surface formed in said at least one lock release operation wall is formed into a circular arc shape extending from a middle portion of said lock release operation wall toward said outer surface of the male connector.

10. The lock release structure of claim 6, wherein a notched grip portion is formed on an outer free end surface of said lock release operation wall.

11. The lock release structure of claim 6, wherein the lock portion of the female connector is an inner wall portion formed on an inner surface of a hood portion of the female connector.

* * * * *